US009252517B2

(12) United States Patent
Kimura

(10) Patent No.: US 9,252,517 B2
(45) Date of Patent: Feb. 2, 2016

(54) CONNECTOR

(71) Applicant: JAPAN AVIATION ELECTRONICS INDUSTRY, LIMITED, Shibuya-ku, Tokyo (JP)

(72) Inventor: Kousuke Kimura, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 16 days.

(21) Appl. No.: 14/331,884

(22) Filed: Jul. 15, 2014

(65) Prior Publication Data

US 2015/0044919 A1 Feb. 12, 2015

(30) Foreign Application Priority Data

Aug. 8, 2013 (JP) ..... 2013-164975

(51) Int. Cl.

| | |
|---|---|
| ***H01R 4/48*** | (2006.01) |
| ***H01R 12/85*** | (2011.01) |
| *H01R 12/71* | (2011.01) |
| *H01R 12/73* | (2011.01) |
| *H01R 13/24* | (2006.01) |

(52) U.S. Cl.

CPC ..... *H01R 12/85* (2013.01); *H01R 12/716* (2013.01); *H01R 12/73* (2013.01); *H01R 13/2492* (2013.01)

(58) Field of Classification Search

CPC ..... H01R 12/85; H01R 12/716; H01R 12/73; H01R 4/48; H01R 13/2492

USPC ..... 439/862, 660

See application file for complete search history.

(56) References Cited

U.S. PATENT DOCUMENTS

| | | | | |
|---|---|---|---|---|
| 6,010,370 | A * | 1/2000 | Aihara et al. | 439/660 |
| 7,510,445 | B2 | 3/2009 | Tokunaga | |
| 8,152,548 | B2 | 4/2012 | Masuda et al. | |

FOREIGN PATENT DOCUMENTS

| | | | |
|---|---|---|---|
| JP | 63061774 | U | 4/1988 |
| JP | 2006269418 | A | 10/2006 |
| JP | 2008071517 | A | 3/2008 |
| JP | 2009037970 | A | 2/2009 |
| JP | 2010272320 | A | 12/2010 |

* cited by examiner

*Primary Examiner* — Javaid Nasri

(74) *Attorney, Agent, or Firm* — Holtz, Holtz & Volek PC

(57) ABSTRACT

A connector is mateable with a mating connector comprising a mating contact. The connector comprises a contact which is brought into contact with the mating contact at two points under a mated state. The contact has a first spring portion, a protruding portion protruding from the first spring portion, a slide portion extending flat and a second spring portion. The protruding portion has a first contact portion while the slide portion has a second contact portion. The first contact portion is movable by first resilient deformation of the first spring portion while the second contact portion is movable by second resilient deformation of the second spring portion. One of the first contact portion and the second contact portion is moved because of both the first resilient deformation and the second resilient deformation when the connector is transited from a mating start state to the mated state.

10 Claims, 13 Drawing Sheets

CONNECTOR

CROSS REFERENCE TO RELATED APPLICATIONS

An applicant claims priority under 35 U.S.C. §119 of Japanese Patent Application No. JP2013-164975 filed Aug. 8, 2013.

BACKGROUND OF THE INVENTION

This invention relates to a connector which is mateable with a mating connector comprising a mating contact, wherein the connector comprises a contact to be brought into contact with the mating contact at two points.

For example, this type of connector is disclosed in each of JP-U S63-61774 (Patent Document 1) and JP-A 2010-272320 (Patent Document 2), the contents of which are incorporated herein by reference.

As shown in FIG. 24, a first connector (connector) 900 of Patent Document 1 is mateable along a mating direction with a second connector (mating connector) 920 comprising contacts (mating contacts) 930. Each of the mating contacts 930 has two contact portions, namely, a first mating contact portion 932 and a second mating contact portion 934. The connector 900 comprises contacts 910. Each of the contacts 910 has two contact portions, namely, a first contact portion 912 and a second contact portion 914. Under a mated state where the connector 900 and the mating connector 920 are mated with each other, the first contact portion 912 is brought into contact with the second mating contact portion 934 while the second contact portion 914 is brought into contact with the first mating contact portion 932.

As shown in FIG. 25, a second connector (connector) 960 according to a second embodiment of Patent Document 2 is mateable along a mating direction with a first connector (mating connector) 950 comprising first contacts (mating contacts) 952. The connector 960 is a floating connector. In detail, the connector 960 comprises a cylindrical portion 962, a mating portion 964 and second contacts (contacts) 966. The mating portion 964 is supported by the cylindrical portion 962 to be movable in a plane perpendicular to the mating direction. The contacts 966 are held by the mating portion 964. Each of the contacts 966 is to be brought into contact with the corresponding mating contact 952 at two points.

As can be seen from FIG. 24, the first contact point 912 of the connector 900 is supported to be substantially unmovable while the second mating contact portion 934 of the mating connector 920 is resiliently supported to be movable in an up-down direction perpendicular to the mating direction. When the connector 900 is moved relative to the mating connector 920 in the up-down direction, a contact force between the first contact point 912 and the second mating contact portion 934 or a contact force between the second contact point 914 and the second mating contact portion 932 might be weakened. Thus, according to the structure of Patent Document 1, contact reliability between the contacts might be degraded.

As can be seen from FIG. 25, the contacts 966 of Patent Document 2 are moved when the mating portion 964 is moved relative to the cylindrical portion 962. Accordingly, contact reliability between the contact 966 and the mating contact 952 might be degraded.

SUMMARY OF THE INVENTION

It is therefore an object of the present invention to provide a connector comprises a contact which is to be brought into contact with a mating contact at two points and which has a new structure to improve contact reliability with a mating contact.

One aspect (first aspect) of the present invention provides a connector mateable with a mating connector along a mating direction. The mating connector comprises a mating contact. The mating contact having a mating contact portion. The connector comprises a contact. The contact is brought into contact with the mating contact at two points under a mated state where the connector is mated with the mating connector. The contact has a protruding portion, a first spring portion, a slide portion and a second spring portion. The protruding portion protrudes from the first spring portion and has a first contact portion. The first contact portion is movable by resilient deformation of the first spring portion to have a movement in a predetermined direction which is perpendicular to the mating direction. The first contact portion is brought into contact with the mating contact under the mated state. The slide portion extends flat and has a second contact portion. The second contact portion is movable by resilient deformation of the second spring portion to have a movement in the predetermined direction. The slide portion allows the mating contact portion to slide thereon to the second contact portion when the connector is transited from a mating start state to the mated state. The mating start state is a state where the connector starts to be mated with the mating connector. The second contact portion is brought into contact with the mating contact portion under the mated state. When the connector is transited from the mating start state to the mated state, one of the first contact portion and the second contact portion is moved in the predetermined direction because of both the resilient deformation of the first spring portion and the resilient deformation of the second spring portion.

Another aspect (second aspect) of the present invention provides a connector mateable with a mating connector along a mating direction. The mating connector comprises a mating contact. The connector comprises a contact. The contact is brought into contact with the mating contact at two points under a mated state where the connector is mated with the mating connector. The contact has a first spring portion and a second spring portion. The second spring portion has a first bent portion, a slide portion and a second bent portion. The slide portion extends flat. The first bent portion extends from one of opposite ends of the slide portion to intersect with the slide portion. The first bent portion has a first contact portion. The second bent portion extends from a remaining one of the opposite ends of the slide portion to intersect with the slide portion. The second bent portion has a second contact portion. The first contact portion is movable by resilient deformation of the first spring portion to have a movement in a predetermined direction which is perpendicular to the mating direction. The first contact portion is brought into contact with the mating contact to receive a first contact force from the mating contact under the mated state. The first contact force functions to maintain the mated state The second contact portion is movable by resilient deformation of the second spring portion to have a movement in the predetermined direction. The second contact portion is brought into contact with the mating contact to receive a second contact force from the mating contact under the mated state. The second contact force functions to maintain the mated state. When the connector is transited from the mating start state to the mated state, the second contact portion is moved in the predetermined direction because of both the resilient deformation of the first spring portion and the resilient deformation of the second spring portion. The mating start state is a state where the connector starts to be mated with the mating connector.

The contact according to each of the first aspect and the second aspect of the present invention is brought into contact with the mating contact at two contact points, namely, the first contact point and the second contact point. One of the first contact point and the second contact point is moved in the predetermined direction by the resilient deformations of both of the first spring portion and the second spring portion. Accordingly, contact reliability with the mating contact can be improved.

An appreciation of the objectives of the present invention and a more complete understanding of its structure may be had by studying the following description of the preferred embodiment and by referring to the accompanying drawings.

Figure 1:
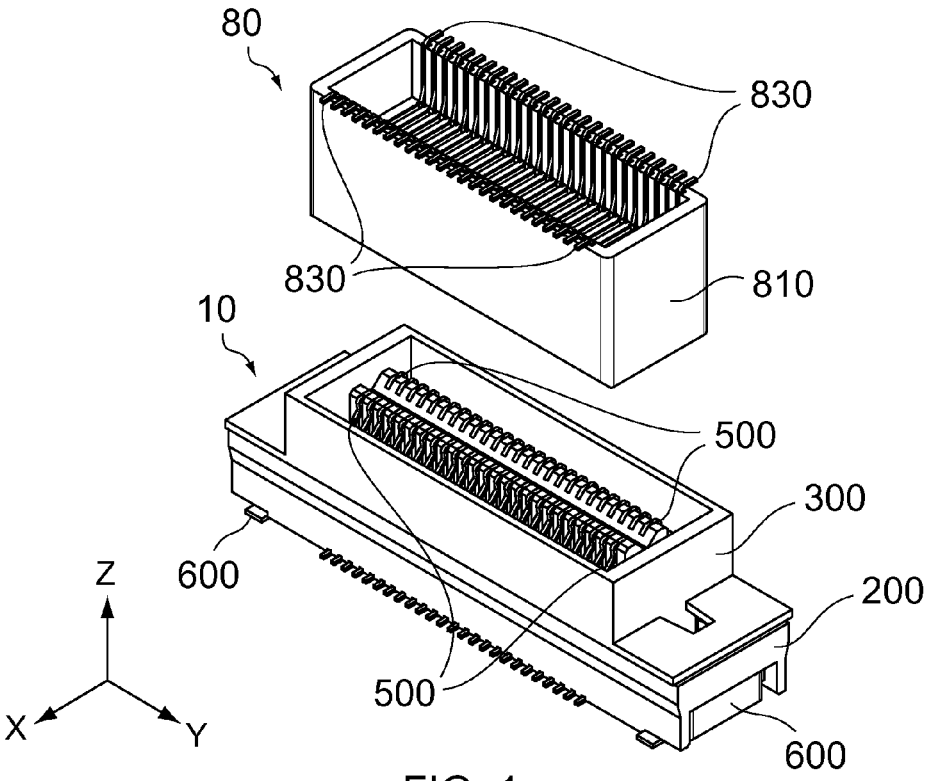
FIG. 1 is a perspective view showing a connector and a mating connector according to a first embodiment of the present invention, wherein the connector and the mating connector are in an unmated state where the connector and the mating connector are not mated with each other.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

First Embodiment

Figure 2:
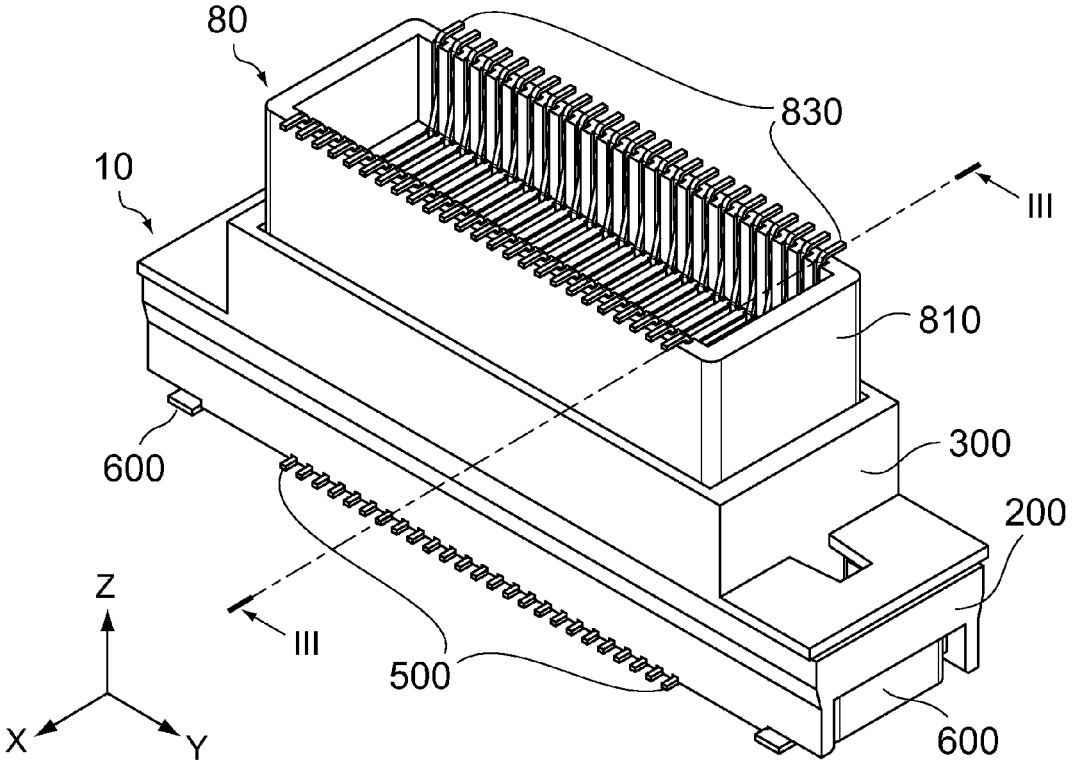
FIG. 2 is a perspective view showing the connector and the mating connector of FIG. 1, wherein the connector and the mating connector are in a mated state where the connector and the mating connector are mated with each other.

As can be seen from FIGS. 1 and 2, a connector 10 according to a first embodiment of the present invention is mateable with a mating connector 80 along a mating direction (Z-direction) and is electrically connectable with the mating connector 80. Each of the connector 10 and the mating connector 80 according to the present embodiment is a board connector that is to be mounted on a circuit board (not shown). However, the present invention is also applicable to a connector other than the board connector.

Figure 6:
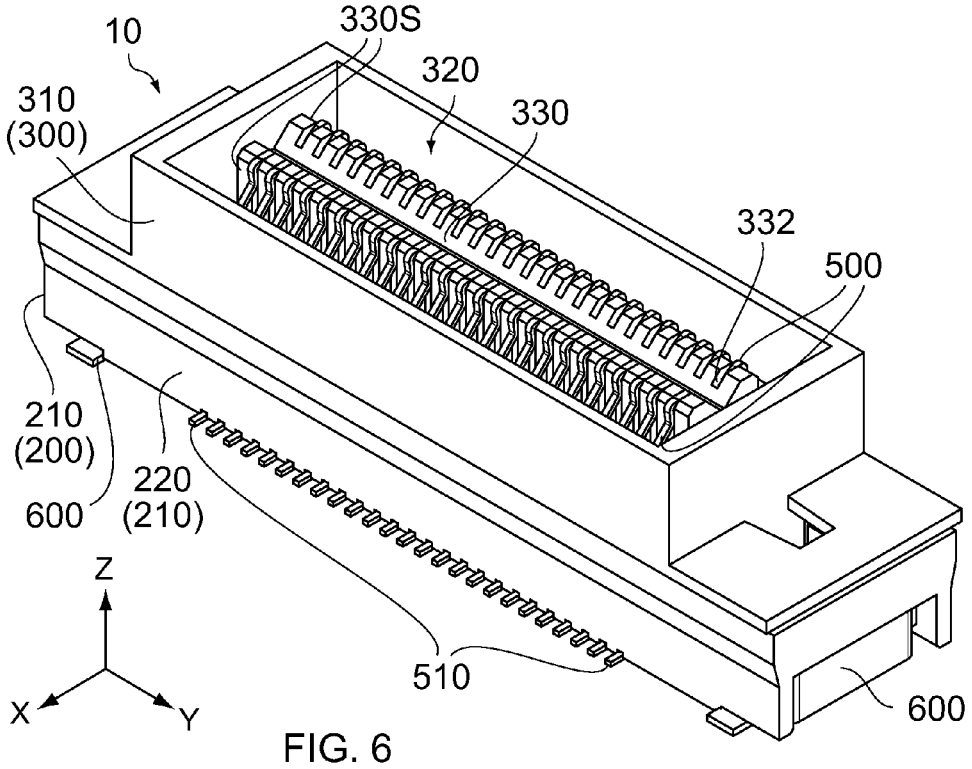
FIG. 6 is a perspective view showing the connector of FIG. 1.
Figure 7:
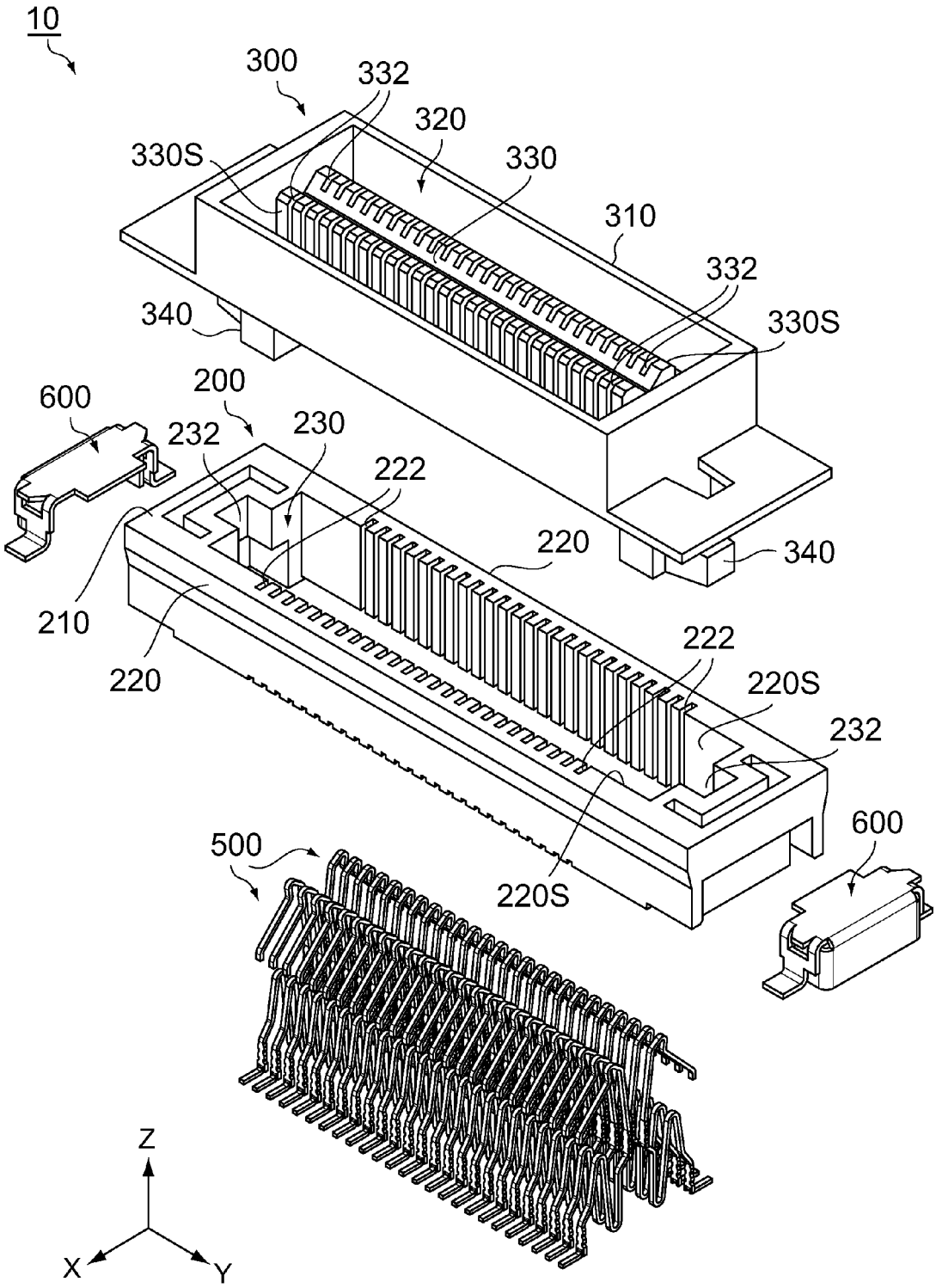
FIG. 7 is an exploded, perspective view showing the connector of FIG. 6.

As shown in FIGS. 1, 6 and 7, the connector 10 comprises a housing, wherein the housing according to the present embodiment is constituted of a first housing (housing) 200 made of an insulating material and a second housing (housing) 300 made of an insulating material. Moreover, the connector 10 comprises a plurality of contacts 500 each made of a conductive material and two fixing members 600 each made of a metal.

As shown in FIG. 7, the first housing 200 has an outer wall 210 and a hole 230. The hole 230 pierces the first housing 200 in the Z-direction while extending long in a pitch direction (Y-direction). The hole 230 has two support portions 232. The support portions 232 are located at opposite ends of the hole 230 in the Y-direction, respectively. The outer wall 210 encloses the hole 230 in the XY-plane. The outer wall 210 has two sidewalls 220 extending long in the Y-direction. Each of the sidewalls 220 has an inner surface 220S. The inner surfaces 220S face the hole 230 in a predetermined direction (X-direction). Each of the inner surfaces 220S is formed with a plurality of ditches 222. Each of the ditches 222 is formed such that a part of the inner surface 220S of the sidewall 220 is recessed outward in a width direction (X-direction).

Figure 4:
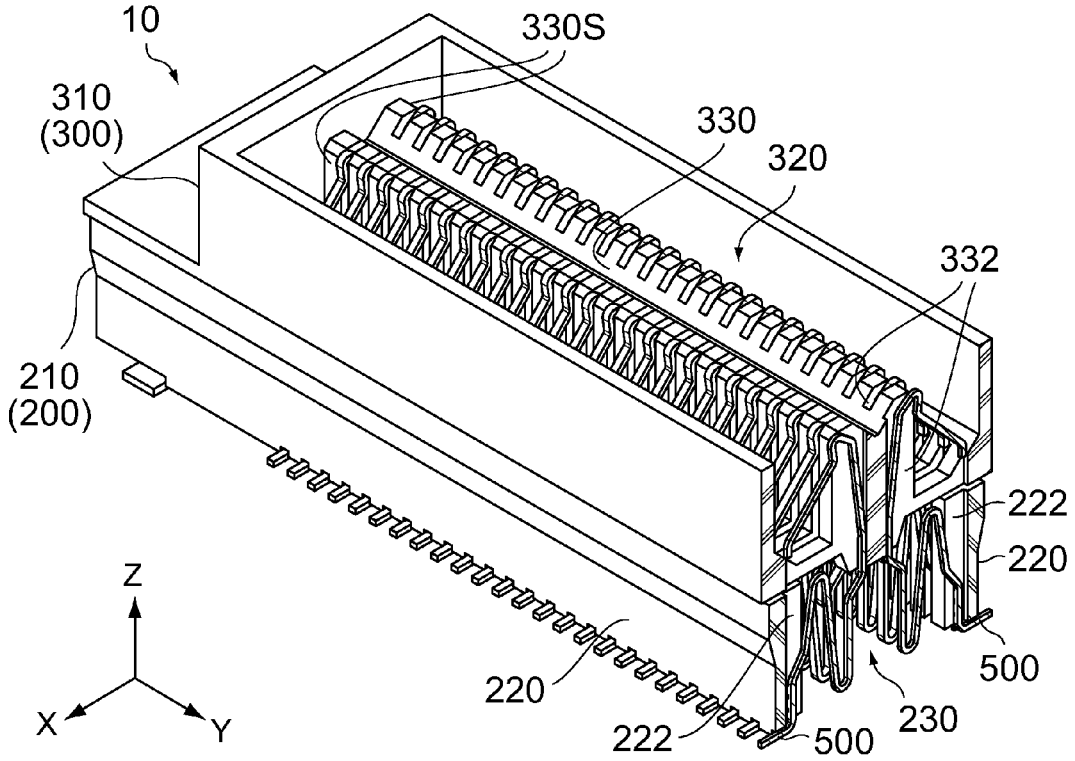
FIG. 4 is a partially cut-away, perspective view showing the connector of FIG. 3, wherein the connector is in the unmated state.
Figure 5:
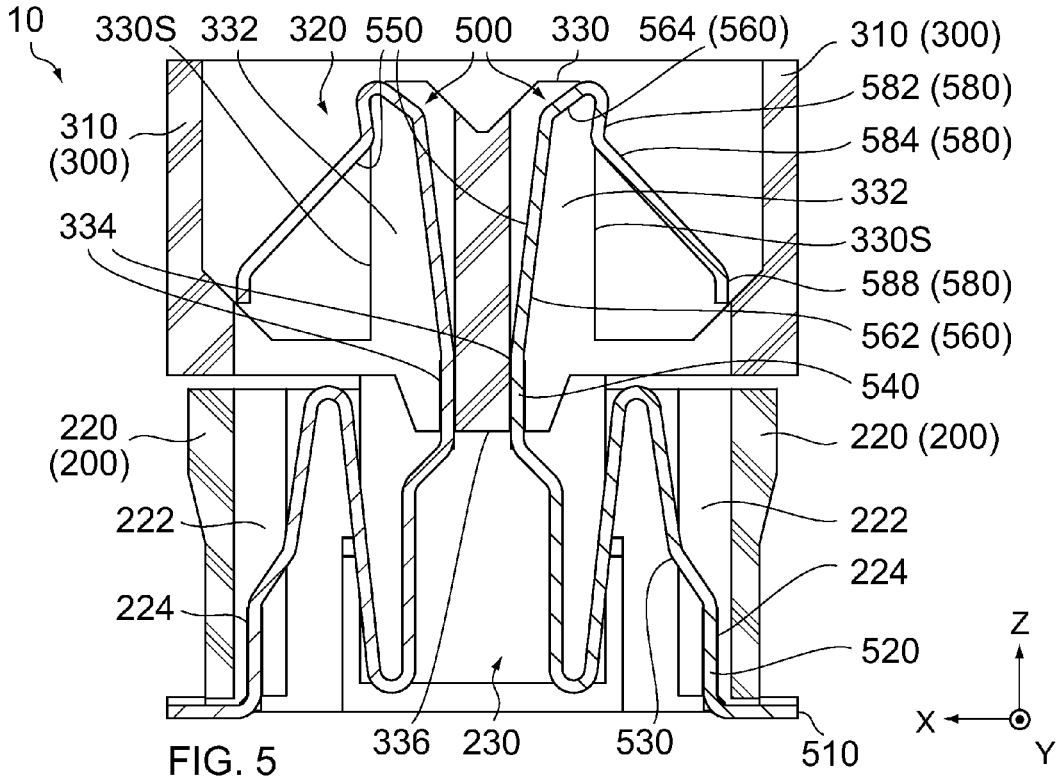
FIG. 5 is a cross-sectional view showing the connector of FIG. 4.

As shown in FIGS. 4, 5 and 7, the ditches 222 extend from an upper end (positive Z-side end) to a lower end (negative Z-side end) of the sidewall 220 in the Z-direction. Each of the ditches 222 is formed with a first holder 224 into which a part of the contact 500 can be press-fit (see FIG. 5).

As shown in FIG. 7, the second housing 300 has an outer wall 310, a recessed portion 320, a protruding portion 330 and two supported portions 340. The recessed portion 320 is a recess recessed in the Z-direction. In the XY-plane, the outer wall 310 encloses the recessed portion 320 while the recessed portion 320 encloses the protruding portion 330. The protruding portion 330 extends long in the Y-direction while protruding in the positive Z-direction. The protruding portion 330 has two side surfaces 330S. The side surfaces 330S face the recessed portion 320 in the X-direction. Each of the side surfaces 330S is formed with a plurality of ditches 332. Each of the ditches 332 is formed such that a part of the side surface 330S is recessed inward in the X-direction.

As shown in FIG. 5, the protruding portion 330 has a middle wall 336. The middle wall 336 is located at the middle of the protruding portion 330 in the X-direction while extending long in the Y-direction. The ditches 332 are recessed from the side surfaces 330S to the middle wall 336 in the X-direction.

As shown in FIGS. 4, 5 and 7, the ditches 332 extend from an upper end to a lower end of the protruding portion 330 in the Z-direction. Each of the ditches 222 is formed with a second holder 334 into which a part of the contact 500 can be press-fit (see FIG. 5). The second holder 334 is located in the vicinity of a lower end of the ditch 332 and in the vicinity of the middle wall 336.

As can be seen from FIG. 7, each of the supported portions 340 extends downward (in the negative Z-direction) from a lower end of the outer wall 310. As can be seen from FIGS. 6 and 7, the supported portions 340 are inserted in the first housing 200 with a space left within the first housing 200, wherein the space allows the supported portion 340 to move in the XY-plane to some extent. In detail, the supported portions 340 are partially inserted in the support portions 232 of the hole 230, respectively, so that a movement of the second housing 300 relative to the first housing 200 is allowed.

As can be seen from FIGS. 6 and 7, the fixing members 600 are attached to opposite ends in the Y-direction of the outer wall 210 of the first housing 200, respectively. When the connector 10 is mounted on a circuit board (not shown), the fixing members 600 are fixed to the circuit board by soldering or the like.

As shown in FIGS. 6 and 7, the contacts 500 according to the present embodiment are arranged in two rows extending in the Y-direction. According to the present embodiment, in each row, a plurality of the contacts 500 are arranged.

Figure 8:
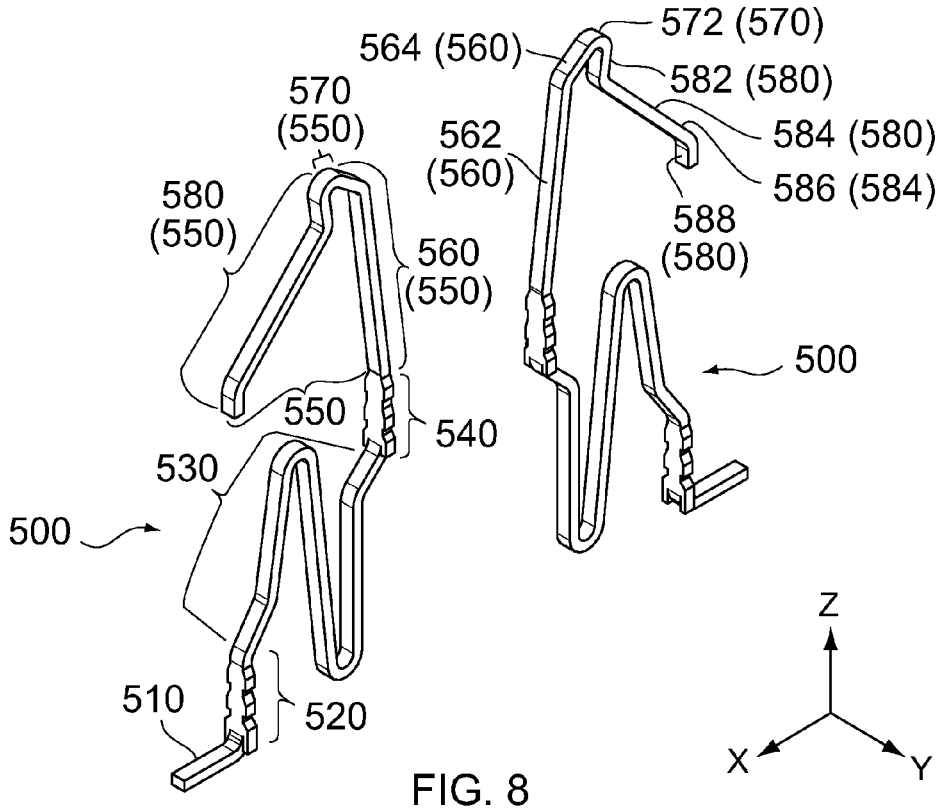
FIG. 8 is a perspective view showing contacts of the connector of FIG. 7.

As shown in FIG. 8, the contact 500 in one of the rows has a shape obtained by rotating the contact 500 in a remaining one of the rows by 180° around an axis in parallel to the Z-direction. The contact 500 according to the present embodiment is formed by punching out a blank (not shown), or an intermediate metal plate having a developed shape, from a single metal plate (not shown) and subsequently bending the blank around an axis in parallel to the Y-direction.

As shown in FIGS. 5 and 8, each of the contacts 500 has a terminal portion 510, a first held portion 520, a coupling portion 530, a second held portion 540 and a body portion 550. When the connector 10 is mounted on a circuit board (not shown), the terminal portion 510 is connected to a signal pattern (not shown) of the circuit board. The first held portion 520 extends upward (in the positive Z-direction) from the terminal portion 510. The first held portion 520 is press-fit into and held by the first holder 224 of the first housing 200. The coupling portion 530 couples the first held portion 520 and the second held portion 540 with each other. The second held portion 540 extends upward from the coupling portion 530. The second held portion 540 is press-fit into and held by the second holder 334 of the second housing 300. The body portion 550 extends from the second held portion 540 to be located above the second held portion 540.

As can be seen from FIG. 5, the contact 500 is held by both the first housing 200 and the second housing 300. In detail, the contact 500 is fixed to the first housing 200 at the first holder 224 while being fixed to the second housing 300 at the second holder 334. Accordingly, the second housing 300 is supported by the contacts 500 to be movable in the Z-direction and in the XY-plane to some extent. The body portions 550 of the contacts 500 is moved by following the movement of the second housing 300. In other words, the connector 10 according to the present embodiment is a floating connector. However, the connector 10 may not be a floating connector. The coupling portion 530 extends between the first held portion 520 and the second held portion 540 while curving up and down (in the Z-direction). Accordingly, even when the second housing 300 is moved relative to the first housing 200, the coupling portion 530 is resiliently deformed to prevent the first held portion 520 and the second held portion 540 from receiving excessive force.

As shown in FIG. 8, the body portion 550 of the contact 500 has a first spring portion 560, a protruding portion 570 and a second spring portion 580. Each of the first spring portion 560 and the second spring portion 580 is resiliently deformable in the XZ-plane. In detail, each of the first spring portion 560 and the second spring portion 580 is resiliently deformable in the X-direction. The protruding portion 570 according to the present embodiment is formed at a boundary between the first spring portion 560 and the second spring portion 580. The protruding portion 570 protrudes from the first spring portion 560 and the second spring portion 580.

As shown in FIGS. 5 and 8, the first spring portion 560 according to the present embodiment is constituted of a first sloping portion 562 and a second sloping portion 564. The first sloping portion 562 extends upward within the ditch 332 while being away from the middle wall 336. The second sloping portion 564 extends in a direction intersecting with the first sloping portion 562 while being further away from the middle wall 336.

The second spring portion 580 extends downward within the recessed portion 320 while approaching the outer wall 310. The second spring portion 580 according to the present embodiment is constituted of a first bent portion 582, a slide portion 584 and a second bent portion 588. In other words, the contact 500 according to the present embodiment has the slide portion 584 as a part of the second spring portion 580. The first bent portion 582 extends downward. The slide portion 584 extends downward from the first bent portion 582 while approaching the outer wall 310. More specifically, the slide portion 584 extends long in a direction intersecting with both the X-direction and the Z-direction. The second bent portion 588 extends downward from the slide portion 584. In other words, the first bent portion 582 extends from one of opposite ends of the slide portion 584 to intersect with the slide portion 584 while the second bent portion 588 extends from a remaining one of the opposite ends of the slide portion 584 to intersect with the slide portion 584.

The slide portion 584 according to the present embodiment is a narrow and long surface linearly extending in a plane perpendicular to both the X-direction and the Z-direction (see FIG. 8). However, the slide portion 584 may extend while gently curving. In other words, the slide portion 584 may extend generally flat.

As shown in FIG. 8, the protruding portion 570 has a first contact portion (contact portion) 572 while the slide portion 584 has a second contact portion (contact portion) 586. The first contact portion 572 is located at a position different from that of the second contact portion 586 in the X-direction. According to the present embodiment, the protruding portion 570 is resiliently supported by the first spring portion 560. Accordingly, the first contact portion 572 is movable by resilient deformation of the first spring portion 560 to have a movement in the X-direction. Moreover, according to the present embodiment, the second contact portion 586 is a part of the surface of the slide portion 584, wherein the slide portion 584 is a part of the second spring portion 580. Accordingly, the second contact portion 586 is movable by resilient deformation of the second spring portion 580 to have a movement in the X-direction. Moreover, the second contact portion 586 according to the present embodiment is movable also by the resilient deformation of the first spring portion 560 to have a movement in the X-direction.

As previously described, the protruding portion 570 is located between the first spring portion 560 and the second spring portion 580. However, based on a different point of view, it can be considered that the protruding portion 570 is formed of the second sloping portion 564 of the first spring portion 560 and the first bent portion 582 of the second spring portion 580. In this case, the protruding portion 570 is constituted of a part of the first spring portion 560 and a part of the second spring portion 580. According to any point of view, the first contact portion 572 protrudes from the first spring portion 560 and the second spring portion 580.

As shown in FIGS. 9 to 12, the mating connector 80 comprises a mating housing 810 made of an insulating material and a plurality of mating contacts 830 each made of a conductive material. The mating connector 80 has a receive portion 82 which opens in the negative Z-direction while extending long in the Y-direction.

Figure 9:
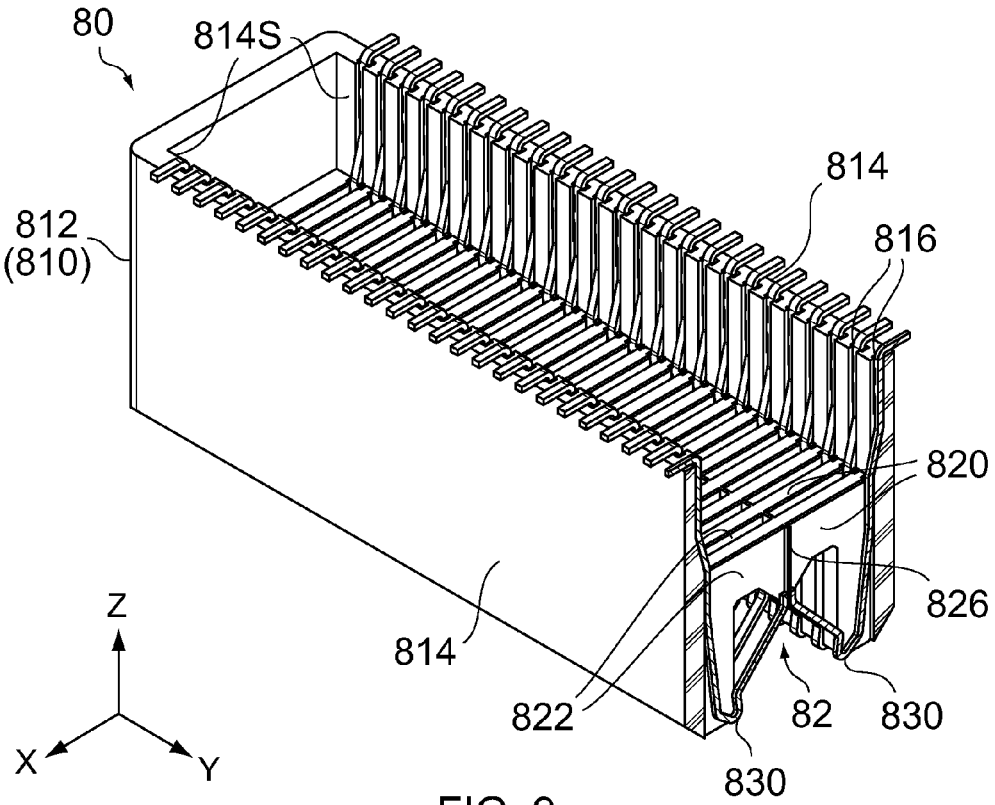
FIG. 9 is a partially cut-away, perspective view showing the mating connector of FIG. 3, wherein the mating connector is in the unmated state.
Figure 11:
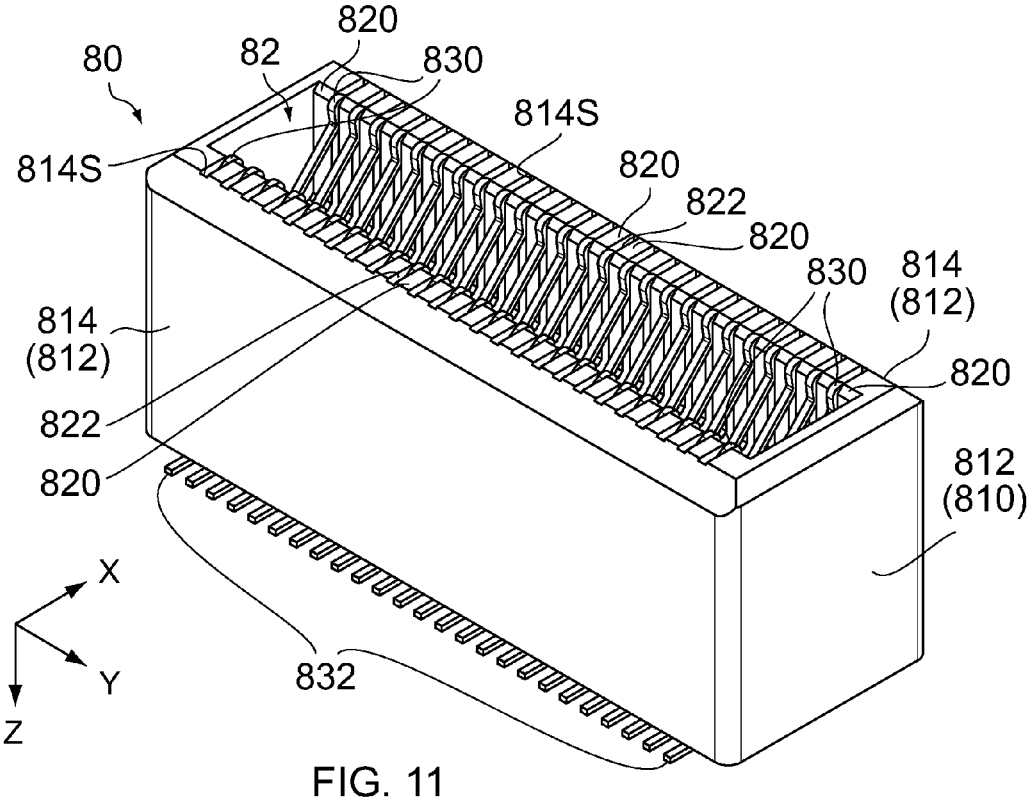
FIG. 11 is a perspective view showing the mating connector of FIG. 1 in an upside down manner.
Figure 12:
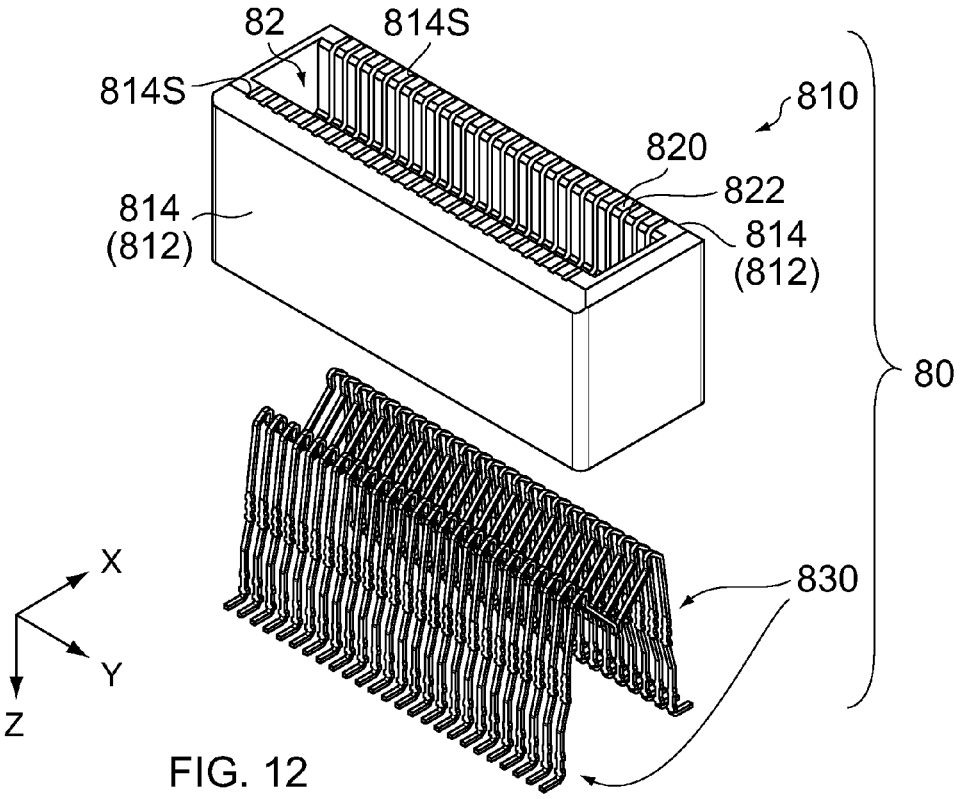
FIG. 12 is an exploded, perspective view showing the mating connector of FIG. 11.

As shown in FIGS. 9, 11 and 12, the mating housing 810 has an outer wall 812. The outer wall 812 has two sidewalls 814 extending long in the Y-direction. Each of the sidewalls 814 has an inner surface 814S. The inner surfaces 814S face the receive portion 82 in the X-direction. Each of the inner surfaces 814S is formed with a plurality of ditches 816. Each of the ditches 816 is formed such that a part of the inner surface 814S of the sidewall 814 is recessed outward in the X-direction.

Figure 10:
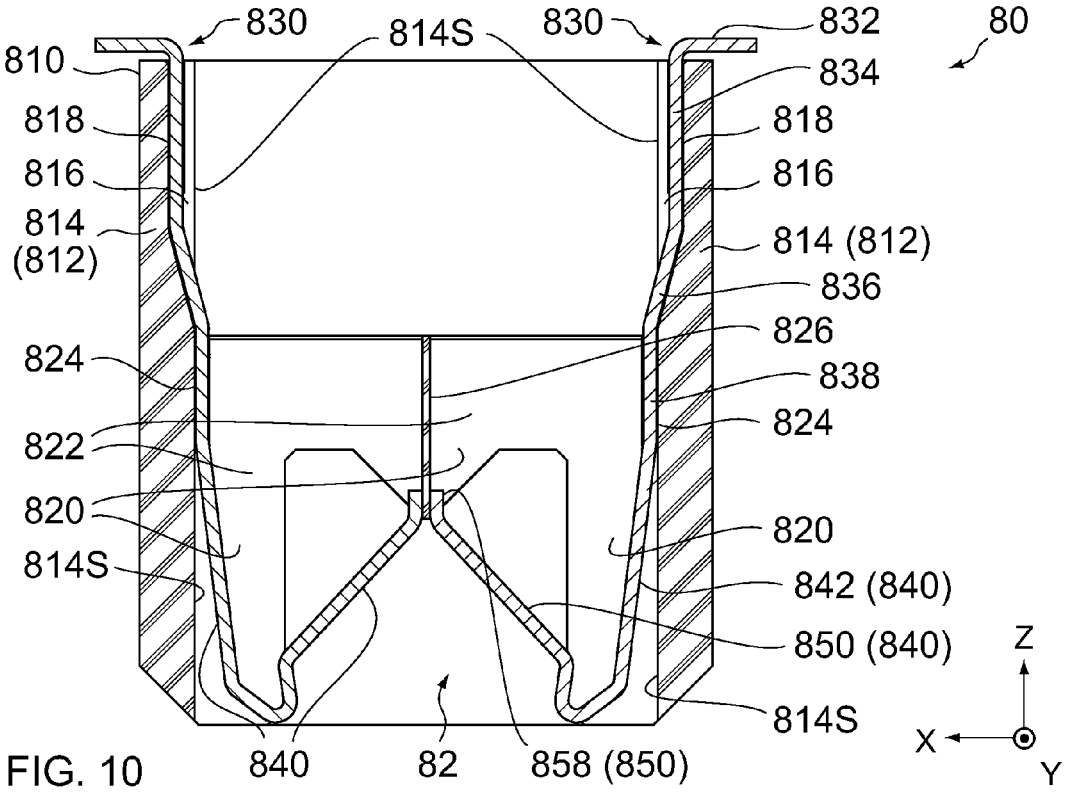
FIG. 10 is cross-sectional view showing the mating connector of FIG. 9.

As shown in FIGS. 9 and 10, the ditches 816 extend from the positive Z-side end of the sidewall 814 to the middle of the sidewall 814 in the Z-direction. Each of the ditches 816 is formed with a first holder 818 into which a part of the mating contact 830 can be press-fit (see FIG. 10).

As shown in FIGS. 10 to 12, the mating housing 810 is provided with a plurality of partition walls 820. Each of the partition walls 820 extends in parallel to the XZ-plane. In detail, the partition wall 820 protrudes inward in the X-direction from the inner surfaces 814S of the opposite sidewalls 814 to couple the two inner surfaces 814S with each other at the middle of the mating housing 810 in the Z-direction (see FIG. 10).

The mating housing 810 is formed with a plurality of slits 822. Each of the slits 822 is located between two of the partition walls 820 in the Y-direction. Each of the slits 822 is formed with two second holders 824, into each of which a part of the mating contact 830 can be press-fit (see FIG. 10). The second holder 824 is located in the vicinity of the positive Z-side end of the slit 822 and in the vicinity of the sidewall 814.

As shown in FIGS. 9 and 10, each of the slits 822 is formed with a separation wall 826. The separation wall 826 is formed at the middle of the slit 822 in the X-direction. The separation wall 826 extends in the Z-direction to separate the slit 822 into two.

Figure 3:
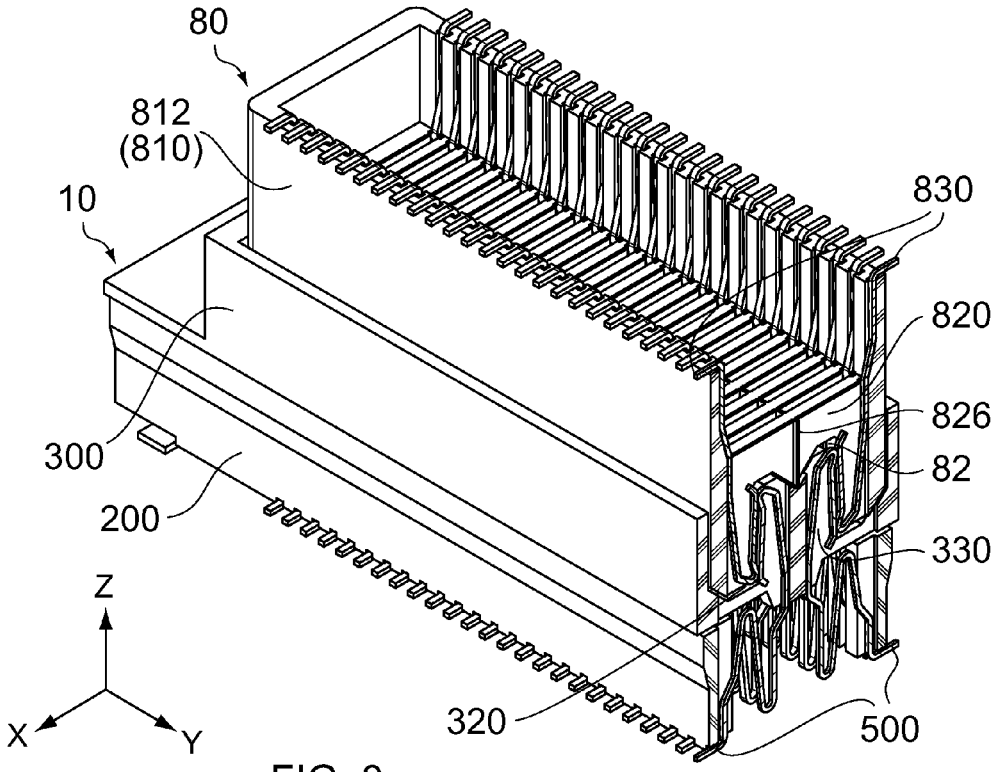
FIG. 3 is a partially cut-away, perspective view showing the connector and the mating connector of FIG. 2, taken along line III-III.

As shown in FIGS. 10 to 12, the receive portion 82 is enclosed by the outer wall 812 and the plurality of the partition walls 820 in the XY-plane. As shown in FIG. 3, under a mated state where the connector 10 and the mating connector 80 are mated with each other, the negative Z-sides of the outer wall 812 and the partition walls 820 are inserted into the recessed portion 320 of the connector 10 while the receive portion 82 receives the protruding portion 330 of the connector 10. At that time, the contacts 500 are brought into contact and electrically connected with the mating contacts 830, respectively.

As shown in FIGS. 11 and 12, the mating contacts 830 according to the present embodiment are arranged in two rows extending in the Y-direction. According to the present embodiment, in each row, a plurality of the mating contacts 830 are arranged.

Figure 13:
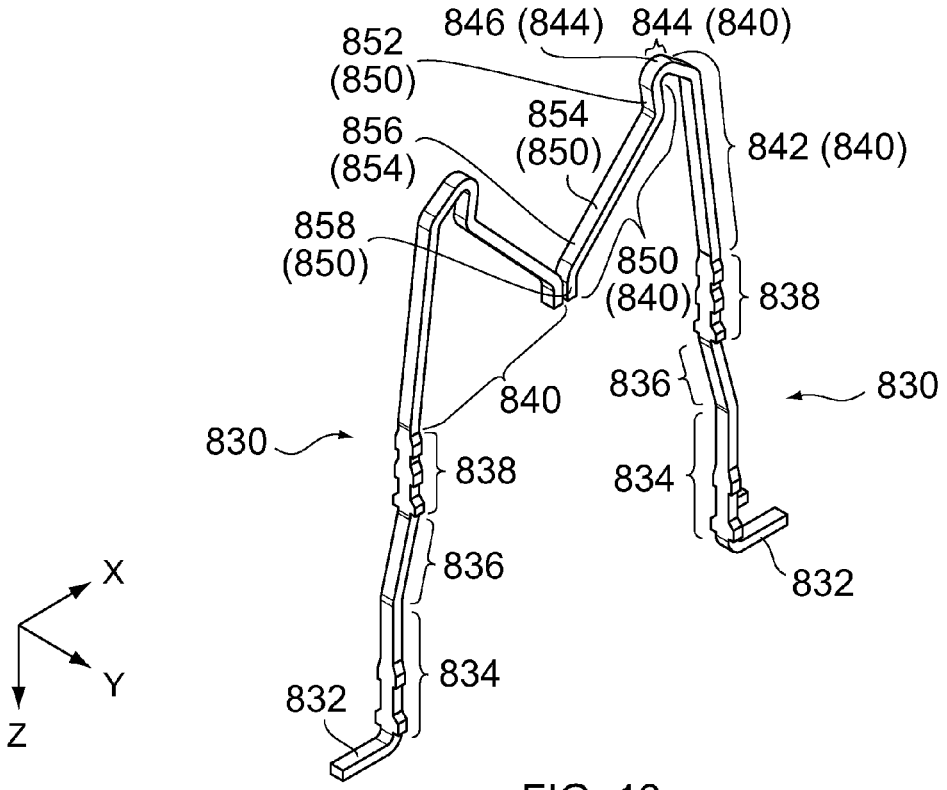
FIG. 13 is a perspective view showing mating contacts of the mating connector of FIG. 12.

As shown in FIG. 13, the mating contact 830 in one of the rows has a shape obtained by rotating the mating contact 830 in a remaining one of the rows by 180° around an axis in parallel to the Z-direction. The mating contact 830 according to the present embodiment is formed by punching out a blank (not shown), or an intermediate metal plate having a developed shape, from a single metal plate (not shown) and subsequently bending the blank around an axis in parallel to the Y-direction.

As shown in FIGS. 10 and 13, each of the mating contacts 830 has a terminal portion 832, a first held portion 834, a coupling portion 836, a second held portion 838 and a body portion 840. When the mating connector 80 is mounted on a circuit board (not shown), the terminal portion 832 is connected to a signal pattern (not shown) of the circuit board. The first held portion 834 extends in the negative Z-direction from the terminal portion 832. The first held portion 834 is press-fit into and held by the first holder 818 of the mating housing 810. The coupling portion 836 couples the first held portion 834 and the second held portion 838 with each other. The second held portion 838 extends in the negative Z-direction from the coupling portion 836. The second held portion 838 is press-fit into and held by the second holder 824 of the mating housing 810. The body portion 840 further extends in the negative Z-direction from the second held portion 838.

As can be seen from FIGS. 8 and 13, according to the present embodiment, the body portion 840 of the mating contact 830, which is a part to be brought into contact with the body portion 550 of the contact 500, has a shape and a size same as those of the body portion 550. Accordingly, the body portion 840 is resiliently deformable like the body portion 550.

In detail, as shown in FIG. 13, the body portion 840 of the mating contact 830 has a first spring portion 842, a protruding portion 844 and a second spring portion 850. Each of the first spring portion 842 and the second spring portion 850 is resiliently deformable in the XZ-plane. In detail, each of the first spring portion 842 and the second spring portion 850 is resiliently deformable in the X-direction. The protruding portion 844 protrudes from the first spring portion 842 and the second spring portion 850.

Similar to the second spring portion 580 (see FIG. 8) of the contact 500, the second spring portion 850 is constituted of a first bent portion 852, a slide portion 854 and a second bent portion 858. Similar to the slide portion 584 (see FIG. 8) of the contact 500, the slide portion 854 extends flat and long. The first bent portion 852 extends from one of opposite ends of the slide portion 854 to intersect with the slide portion 854 while the second bent portion 858 extends from a remaining one of the opposite ends of the slide portion 854 to intersect with the slide portion 854.

As shown in FIG. 10, the first spring portion 842 extends downward (in the negative Z-direction) within the slit 822 while being away from the inner surface 814S of the sidewall 814. The second spring portion 850 projects into the receive portion 82 from the slit 822 to extend upward (in the positive Z-direction) while approaching the separation wall 826. The second bent portion 858 of the second spring portion 850 is in contact with the separation wall 826.

As shown in FIG. 13, the protruding portion 844 has a first mating contact portion (mating contact portion) 846 while the slide portion 854 has a second mating contact portion (mating contact portion) 856. The first mating contact portion 846 is located at a position different from that of the second mating contact portion 856 in the X-direction. The first mating contact portion 846 is movable by resilient deformation of the first spring portion 842 to have a movement in the X-direction. The second mating contact portion 856 is movable by resilient deformation of the second spring portion 850 to have a movement in the X-direction. Moreover, the second mating contact portion 856 is movable also by the resilient deformation of the first spring portion 842 to have a movement in the X-direction.

Figure 14:
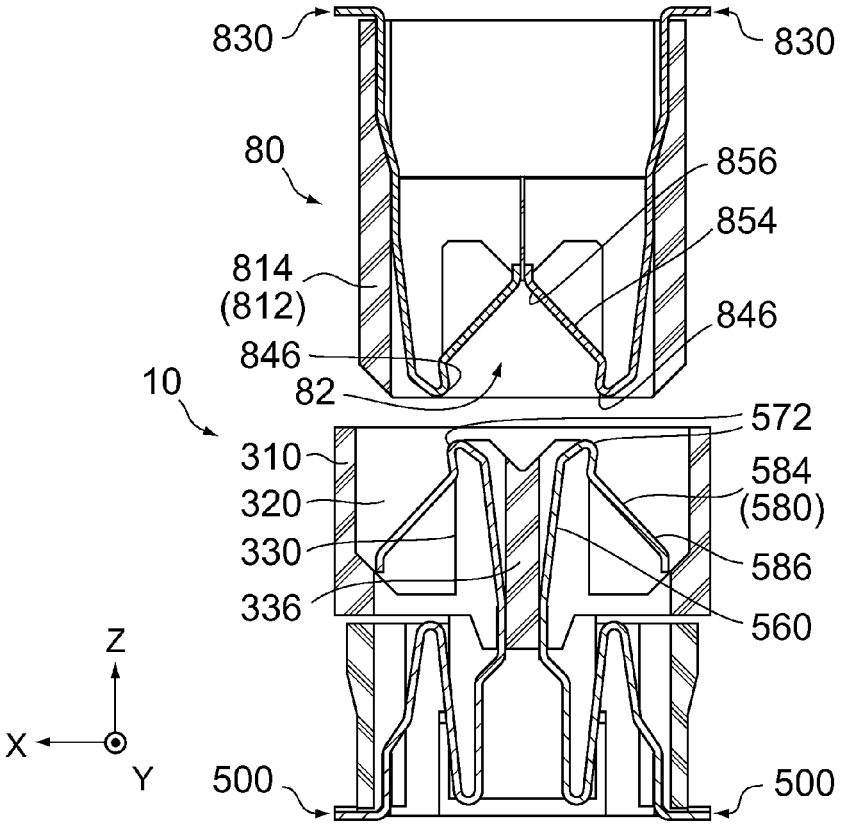
FIG. 14 is a cross-sectional view showing the connector of FIG. 5 and the mating connector of FIG. 10, wherein the connector and the mating connector are in the unmated state.
Figure 15:
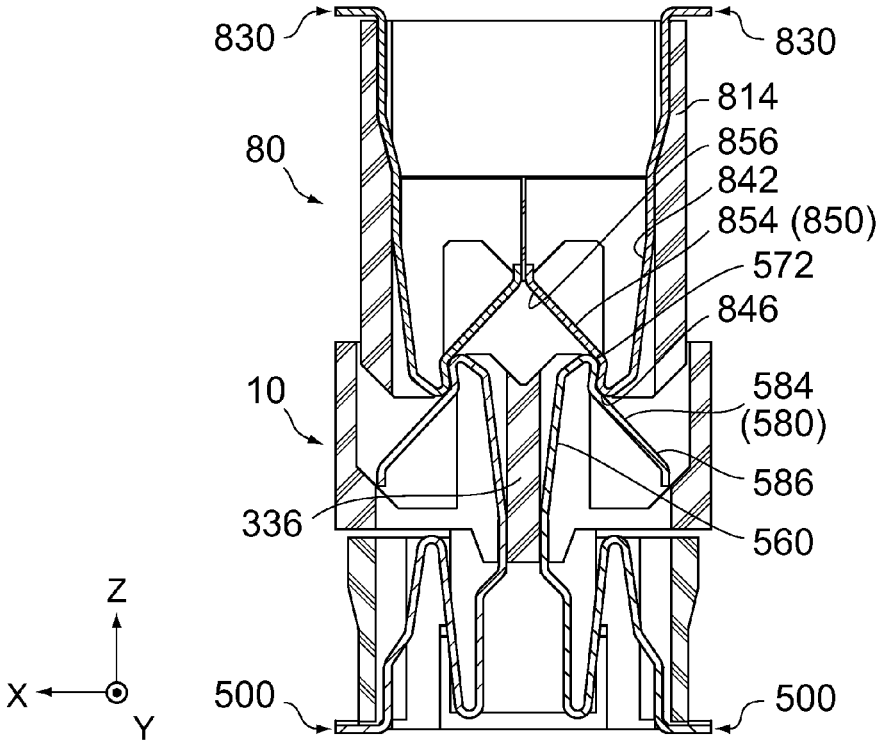
FIG. 15 is a cross-sectional view showing the connector and the mating connector of FIG. 14, wherein the connector and the mating connector are in a mating start state.

As shown in FIGS. 14 and 15, when the connector 10 is to be mated with the mating connector 80, the mating connector 80 is located above the connector 10 in a state where the receive portion 82 opens downward. When the connector 10 is seen along the negative Z-direction, the first contact portions 572 and the second contact portions 586 of the contacts 500 are visible. The first contact portion 572 is located at a position different from that of the first mating contact portion 846 of the mating contact 830 in the X-direction. When the connector 10 is moved toward the mating connector 80 along the Z-direction, the first contact portion 572 and the first mating contact portion 846 are not brought into abutment with each other. Accordingly, the first contact portion 572 and the first mating contact portion 846 can be brought into contact with the slide portion 854 and the slide portion 584, respectively, while the first contact portion 572 and the first mating contact portion 846 are prevented from being damaged (see FIG. 15).

As shown in FIG. 15, under a mating start state where the connector 10 starts to be mated with the mating connector 80, the first contact portion 572 of the contact 500 is brought into contact with a part of the slide portion 854 of the mating contact 830. In the meantime, the first mating contact portion 846 of the mating contact 830 is brought into contact with a part of the slide portion 584 of the contact 500. In other words, under the mating start state, the contact 500 is brought into contact with the mating contact 830 at two points.

Figure 17:
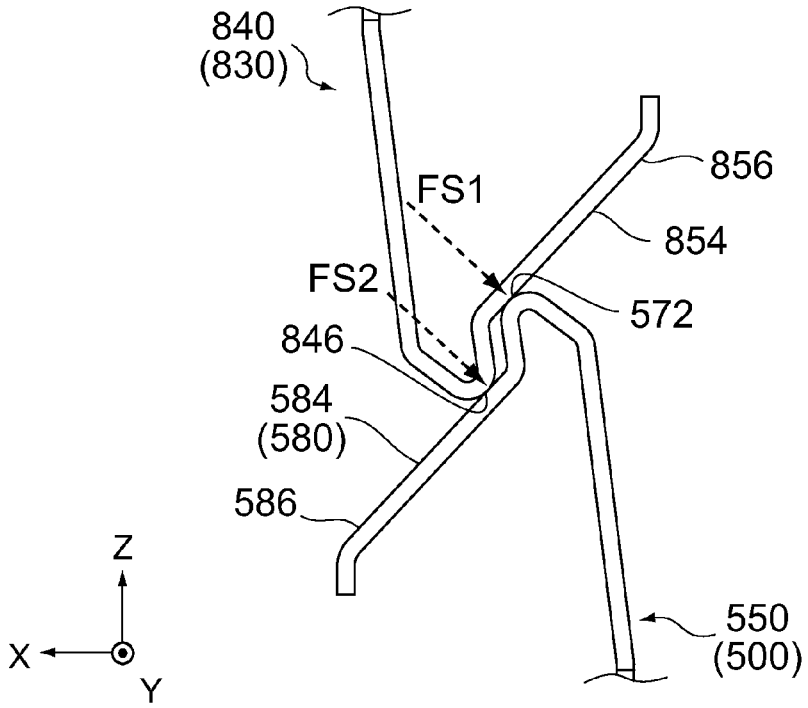
FIG. 17 is a side view showing a body portion of the contact of FIG. 8 and a body portion of the mating contact of FIG. 13 under the mating start state.

As shown in FIG. 17, under the mating start state, the first contact portion 572 of the contact 500 receives a contact force (FS1) from the slide portion 854 of the mating contact 830. Moreover, a part of the slide portion 584 of the contact 500 receives another contact force (FS2) from the first mating contact portion 846 of the mating contact 830. Each of the contact force (FS1) and the contact force (FS2) is directed outward in the X-direction and directed downward.

Figure 16:
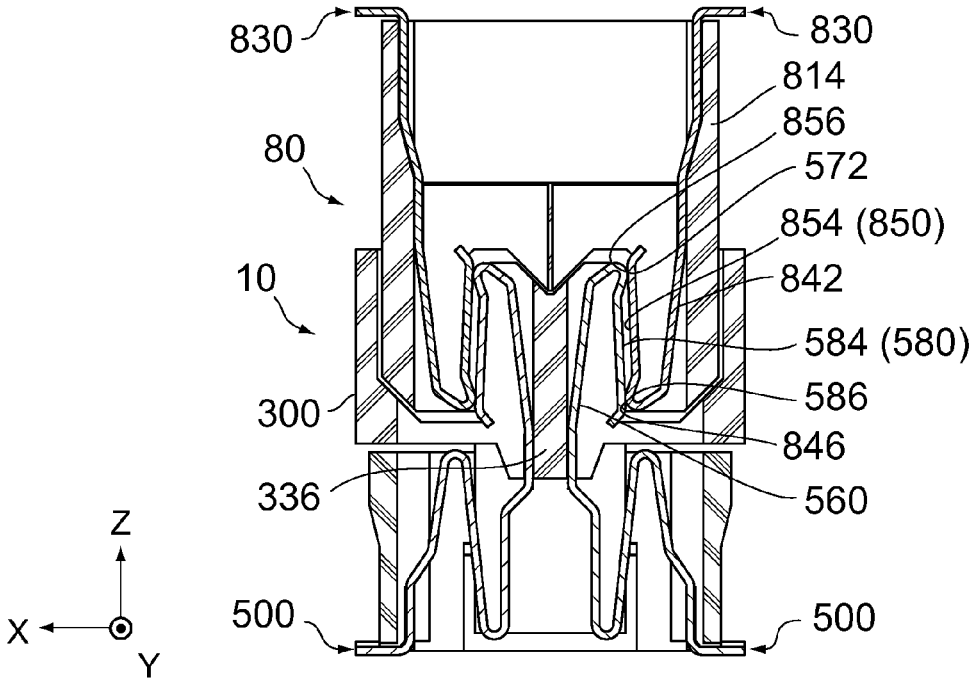
FIG. 16 is a cross-sectional view showing the connector and the mating connector of FIG. 14, wherein the connector and the mating connector are in the mated state.

As can be seen from FIGS. 15 and 16, when the connector 10 is transited from the mating start state (see FIG. 15) to the mated state (see FIG. 16), the first spring portion 560 of the contact 500 is resiliently deformed toward the middle wall 336. The first contact portion 572 and the second contact portion 586 are moved toward the middle wall 336 in the X-direction by the resilient deformation of the first spring portion 560. In the meantime, the second spring portion 580 is also resiliently deformed toward the middle wall 336. As a result, the second contact portion 586 is moved in the X-direction by the resilient deformation of the second spring portion 580 while being moved in the X-direction by the resilient deformation of the first spring portion 560. In the meantime, the first mating contact portion 846 of the mating contact 830 is moved toward the sidewall 814 in the X-direction by the resilient deformation of the first spring portion 842. Moreover, the second mating contact portion 856 is moved toward the sidewall 814 in the X-direction by the resilient deformation of the first spring portion 842 and the resilient deformation of the second spring portion 850.

The slide portion 584 allows the first mating contact portion 846 to slide thereon to the second contact portion 586 when the connector 10 is transited from the mating start state to the mated state. In detail, during the transition of the connector 10 from the mating start state to the mated state, the first mating contact portion 846 is moved long on the slide portion 584 while the first contact portion 572 is moved long on the slide portion 854. Under the mated state, the first mating contact portion 846 arrives at the second contact portion 586 while the first contact portion 572 arrives at the second mating contact portion 856. In other words, under the mated state, the first contact portion 572 and the second contact portion 586 are brought into contact with the second mating contact portion 856 and the first mating contact portion 846, respectively. Thus, even under the mated state, the contact 500 is brought into contact with the mating contact 830 at two points.

Figure 18:
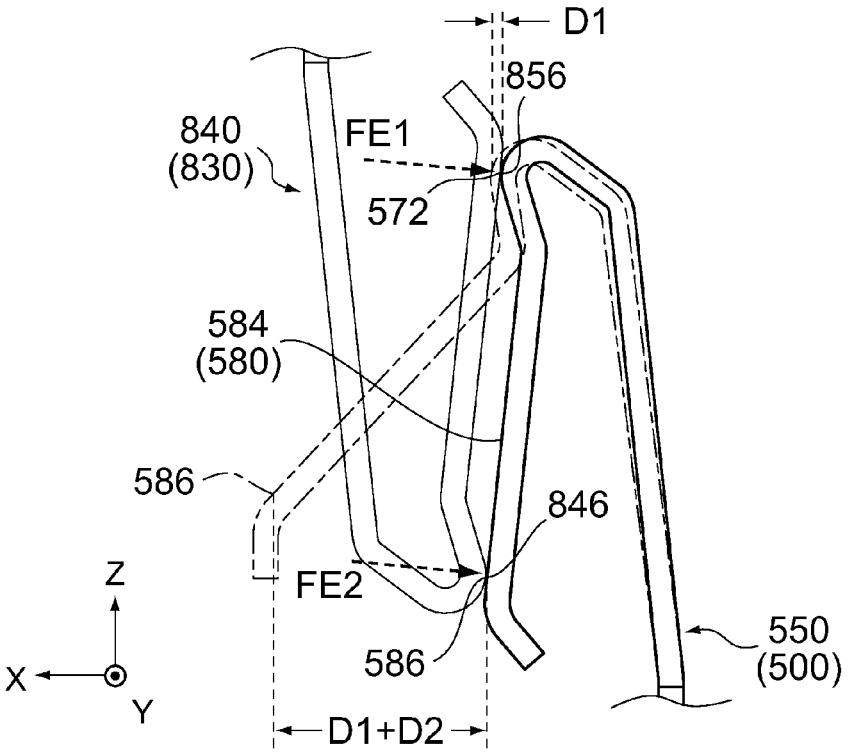
FIG. 18 is a side view showing the body portion of the contact and the body portion of the mating contact of FIG. 17 under the mated state, wherein the shape of the body portion of the contact under the unmated state is illustrated by chain dotted line.

As shown in FIG. 18, when the connector 10 is transited from the mating start state to the mated state, the first contact portion 572 is moved by a first distance (D1) in the X-direction because of the resilient deformation of the first spring portion 560. In the meantime, the second contact portion 586 is moved by a second distance (D2) in addition to the first distance (D1) in the X-direction because of both the resilient deformation of the first spring portion 560 and the resilient deformation of the second spring portion 580. In other words, the second contact portion 586 is moved by the second distance (D2) in the X-direction because of the resilient deformation of the second spring portion 580. Although the first spring portion 560 shows a relatively large contact force under the mated state, the first spring portion 560 is hardly deformed during the mating. In contrast, although the second spring portion 580 shows a relatively small contact force under the mated state, the second spring portion 580 is largely deformed during the mating. Accordingly, the second distance (D2) is larger than the first distance (D1).

As described above, the second contact portion 586 is moved by the resilient deformations of two kinds of the springs which complement on their functions each other. Accordingly, the second contact portion 586 is kept to be in contact with the first mating contact portion 846 by a sufficient contact force, for example, even when the second housing 300 (see FIG. 3) is moved in the X-direction relative to the mating housing 810 (for example, when the mating position is out of position to be shifted in the negative X-direction or the positive X-direction). In other words, the second contact portion 586 is in stable contact with the first mating contact portion 846. Moreover, similar to the second contact portion 586, the second mating contact portion 856 is moved by the resilient deformations of two kinds of the springs. Accordingly, the first contact portion 572 is in stable contact with the second mating contact portion 856. Moreover, even when the first contact portion 572 or the first mating contact portion 846 is vertically out of position (in the Z-direction) to some extent, the first contact portion 572 and the second contact portion 586 are in stable contact with the second mating contact portion 856 and the first mating contact portion 846, respectively. According to the present embodiment, contact reliability between the contact 500 and the mating contact 830 can be improved.

As can be seen from FIGS. 15 to 18, while the connector 10 is transited from the mating start state to the mated state, the first contact portion 572 continuously receives a contact force from a part of the slide portion 854 of the mating contact 830. According to the present embodiment, while the connector 10 is transited from the mating start state to the mated state, the direction of the contact force is continuously changed as the inclination of the slide portion 854 is changed. Under the mated state, the first contact portion 572 receives a contact force (FE1) from the second mating contact portion 856. The direction of the contact force (FE1) under the mated state is different from the direction of the contact force (FS1) under the mating start state.

Similarly, while the connector 10 is transited from the mating start state to the mated state, a part of the slide portion 584 continuously receives a contact force from the first mating contact portion 846. According to the present embodiment, while the connector 10 is transited from the mating start state to the mated state, the direction of the contact force is continuously changed as the inclination of the slide portion 584 is changed. Under the mated state, the second contact portion 586 of the slide portion 584 receives a contact force (FE2) from the first mating contact portion 846. The direction of the contact force (FE2) under the mated state is different from the direction of the contact force (FS2) under the mating start state.

Especially, according to the present embodiment, each of the direction of the contact force (FE1) and the direction of the second contact force (FE2) under the mated state is almost perpendicular to the Z-direction. Accordingly, under the mated state, such a force that removes the mating connector 80 from the connector 10 is hardly generated. According to the present embodiment, the mated state can be relatively securely maintained. On the other hand, as can be seen from FIG. 17, the mating connector 80 can be easily removed from the connector 10 by using reaction forces due to the contact forces.

Each of the direction of the contact force (FE1) and the direction of the second contact force (FE2) under the mated state may be completely perpendicular to the Z-direction. In contrast, as shown in FIG. 19, the contact 500 and the mating contact 830 can be modified so that each of the direction of the contact force (FE1) and the direction of the second contact force (FE2) is directed outward in the X-direction and directed upward.

Figure 19:
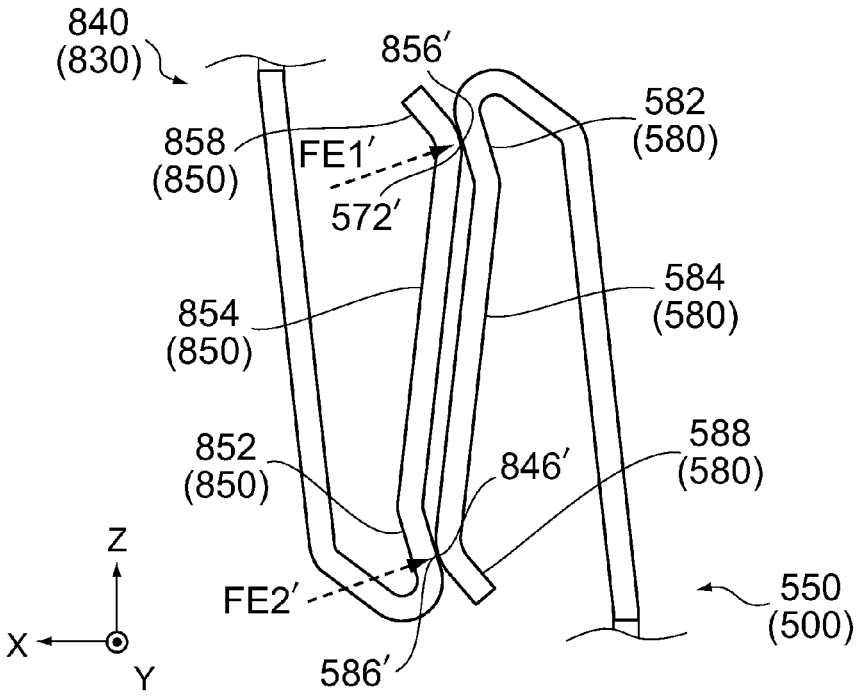
FIG. 19 is a side view showing modifications of the body portion of the contact and the body portion of the mating contact of FIG. 18.

According to the modification shown in FIG. 19, under the mated state, a part of the first bent portion 582 of the second spring portion 580 is brought into contact with a boundary between the slide portion 854 and the second bent portion 858 of the second spring portion 850. At that time, a boundary between the slide portion 584 and the second bent portion 588 of the second spring portion 580 is brought into contact with a part of the first bent portion 852 of the second spring portion 850. In other words, the first bent portion 582 of the contact 500 has a first contact portion 572' while the second bent portion 588 has a second contact portion 586'. Similarly, the first bent portion 852 of the mating contact 830 has a first mating contact portion (mating contact portion) 846' while the second bent portion 858 has a second mating contact portion (mating contact portion) 856'.

The first contact portion 572' is brought into contact with the second mating contact portion 856' of the mating contact 830 to receive a contact force (FE1') from the second mating contact portion 856' under the mated state. The contact force (FE1') functions to maintain the mated state. Moreover, the second contact portion 586' is brought into contact with the first mating contact portion 846' of the mating contact 830 to receive a contact force (FE2') from the first mating contact portion 846' under the mated state. The contact force (FE2') functions to maintain the mated state. In other words, the first mating contact portion 846' and the second mating contact portion 856' are locked by the second contact portion 586' and the first contact portion 572', respectively, so that the mated state is maintained.

The connector 10 and the mating connector 80 according to the present embodiment can be variously modified in addition to the aforementioned modifications. For example, the body portion 840 of the mating contact 830 may have a shape and a size different from those of the body portion 550 of the contact 500. More specifically, the mating contact may be a pin contact linearly extending along the Z-direction.

Second Embodiment

Figure 20:
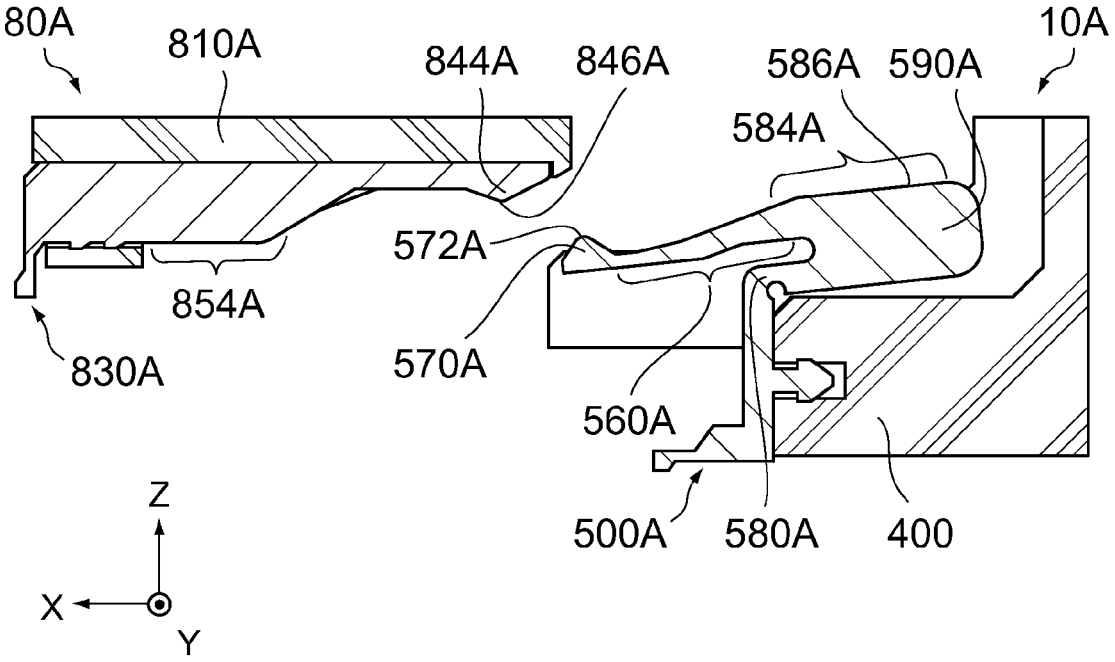
FIG. 20 is a cross-sectional view showing a connector and a mating connector according to a second embodiment of the present invention, wherein the connector and the mating connector are in an unmated state where the connector and the mating connector are not mated with each other.

As shown in FIG. 20, a connector 10A according to a second embodiment of the present invention is mateable a mating connector 80A along a mating direction (X-direction).

The connector 10A comprises a housing 400 made of an insulating material and a contact 500A made of a conductive material. The connector 10A may comprise a plurality of the contacts 500A arranged in a pitch direction (Y-direction). A part of the contact 500A is press-fit in the housing 400, so that the contact 500A is held by the housing 400.

The contact 500A according to the present embodiment is formed by punching out a single metal plate (not shown) without bending it. Accordingly, the contact 500A can be more easily formed in comparison with the contact 500 (see FIG. 8) according to the first embodiment.

The contact 500A has a first spring portion 560A, a protruding portion 570A, a second spring portion 580A and a movable portion 590A. The first spring portion 560A projects from the movable portion 590A to extend long in the positive X-direction while slightly sloping downward (in the negative Z-direction). The first spring portion 560A is resiliently deformable in the XZ-plane (in detail, in the Z-direction). The protruding portion 570A is formed at the positive X-side end of the first spring portion 560A. The protruding portion 570A protrudes upward (in the positive Z-direction) from the first spring portion 560A. The second spring portion 580A projects in the positive X-direction from the movable portion 590A and subsequently extends downward. The second spring portion 580A is resiliently deformable in the XZ-plane (in detail, in the Z-direction). The movable portion 590A is movable in the XZ-plane by resilient deformation of the second spring portion 580A (see FIG. 22).

The contact 500A has a slide portion 584A. The slide portion 584A according to the present embodiment is constituted of an upper edge of the first spring portion 560A and an upper edge of the movable portion 590A. The slide portion 584A extends generally flat in a direction intersecting with the X-direction.

The protruding portion 570A has a first contact portion (contact portion) 572A while the slide portion 584A has a second contact portion (contact portion) 586A. The first contact portion 572A is an upper end portion (positive Z-side end portion) of the protruding portion 570A while the second contact portion 586A is a part of the slide portion 584A. The first contact portion 572A is located at a position different from that of the second contact portion 586A in an up-down direction (Z-direction). The first contact portion 572A is movable by resilient deformation of the first spring portion 560A to have a movement in the Z-direction. Moreover, the first contact portion 572A is movable also by the resilient deformation of the second spring portion 580A to have a movement in the Z-direction. The second contact portion 586A is movable by the resilient deformation of the second spring portion 580A to have a movement in the Z-direction.

As shown in FIG. 20, the mating connector 80A comprises a mating housing 810A made of an insulating material and a mating contact 830A made of a conductive material. A part of the mating contact 830A is press-fit in the mating housing 810A so that the mating contact 830A is held by the mating housing 810A.

The mating contact 830A extends along the X-direction. The mating contact 830A has a protruding portion 844A and a slide portion 854A. The protruding portion 844A is formed at the negative X-side end of the mating contact 830A. The protruding portion 844A protrudes downward. The slide portion 854A according to the present embodiment is a part of a lower edge of the mating contact 830A. The slide portion 584A extends in the X-direction.

Figure 22:
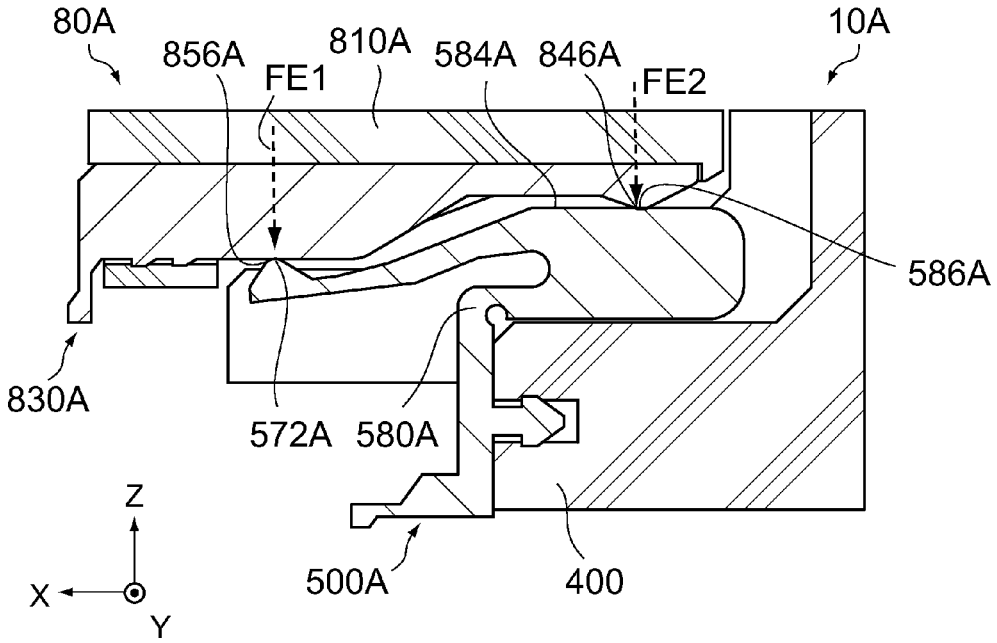
FIG. 22 is a cross-sectional view showing the connector and the mating connector of FIG. 20, wherein the connector and the mating connector are in a mated state where the connector and the mating connector are mated with each other.

The protruding portion 844A has a first mating contact portion (mating contact portion) 846A while the slide portion 854A has a second mating contact portion (mating contact portion) 856A (see FIG. 22). The first mating contact portion 846A is a lower end portion (negative Z-side end portion) of the protruding portion 844A while the second mating contact portion 856A is a part of the slide portion 854A. The first mating contact portion 846A and the second mating contact portion 856A according to the present embodiment are unmovable relative to the mating housing 810A.

Figure 21:
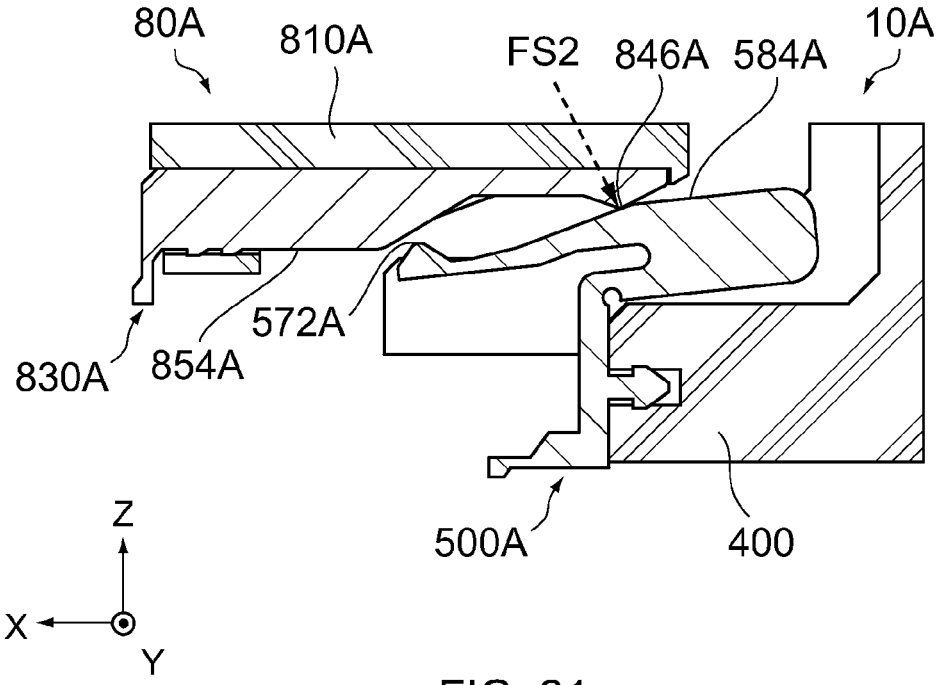
FIG. 21 is a cross-sectional view showing the connector and the mating connector of FIG. 20, wherein the connector and the mating connector are in a mating start state.

As shown in FIGS. 20 and 21, when the connector 10A is to be mated with the mating connector 80A, the connector 10A and the mating connector 80A are arranged along the X-direction. When the connector 10A is seen along the negative X-direction, the first contact portion 572A and the second contact portion 586A of the contact 500A are visible. The first contact portion 572A is located at a position different from that of the first mating contact portion 846A of the mating contact 830A in the Z-direction. Accordingly, when the connector 10A is moved toward the mating connector 80A along the Z-direction, the first contact portion 572A and the first mating contact portion 846A are not brought into abutment with each other.

As shown in FIG. 21, under a mating start state where the connector 10A starts to be mated with the mating connector 80A, the first contact portion 572A of the contact 500A is not brought into contact with the mating contact 830A. On the other hand, the first mating contact portion 846A of the mating contact 830A is brought into contact with a part of the slide portion 584A of the contact 500A. Under the mating start state, the part of the slide portion 584A of the contact 500A receives a contact force (FS2) from the first mating contact portion 846A of the mating contact 830A. The contact force (FS2) is directed in the negative X-direction and directed downward.

As can be seen from FIGS. 21 and 22, the slide portion 584A allows the first mating contact portion 846A to slide thereon to the second contact portion 586A while the connector 10A is transited from the mating start state (see FIG. 21) to a mated state (see FIG. 22). In other words, the first mating contact portion 846A is moved on the slide portion 584A. Under the mated state, the first mating contact portion 846A arrives at the second contact portion 586A to be brought into contact with the second contact portion 586A. Moreover, under a middle-of-mating state between the mating start state and the mated state, the first contact portion 572A is brought into contact with the slide portion 854A of the mating contact 830A. Subsequently, the first contact portion 572A is moved on the slide portion 854A. Under the mated state, the first contact portion 572A arrives at the second mating contact portion 856A to be brought into contact with the second mating contact portion 856A. Thus, the contact 500A is brought into contact with the mating contact 830A at two points under the mated state.

Figure 23:
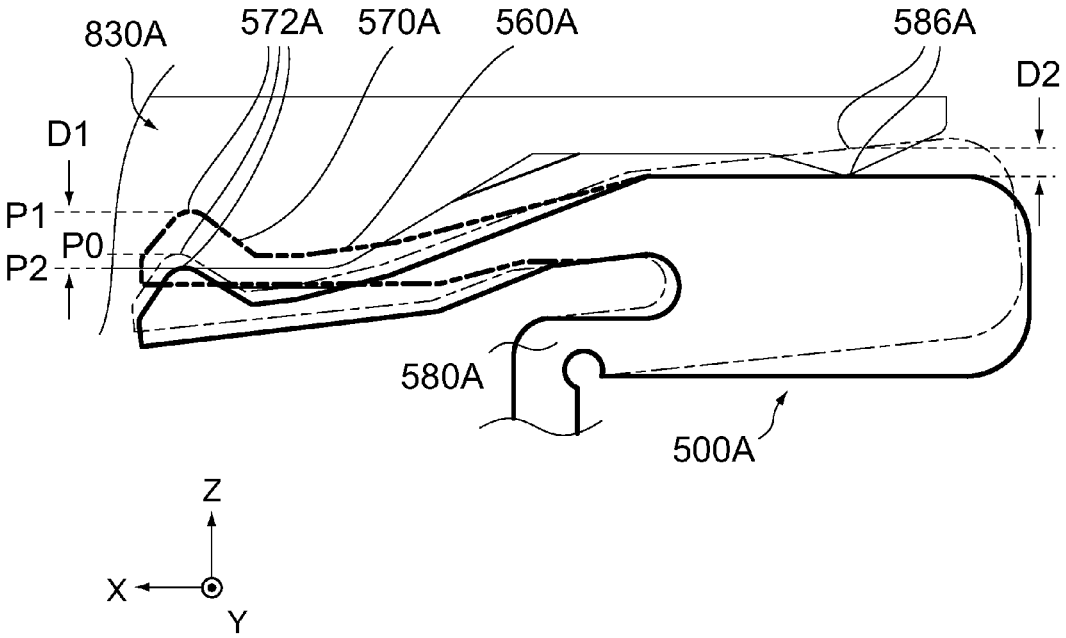
FIG. 23 is a side view mainly showing a contact section between a contact of the connector and a mating contact of the mating connector of FIG. 22, wherein the shape of the contact under the unmated state is illustrated by dotted chain line, and the shape of the contact in a supposed case where a first spring portion of the contact is not resiliently deformed under the mated state is illustrated by two-dot chain line.
Figure 24:
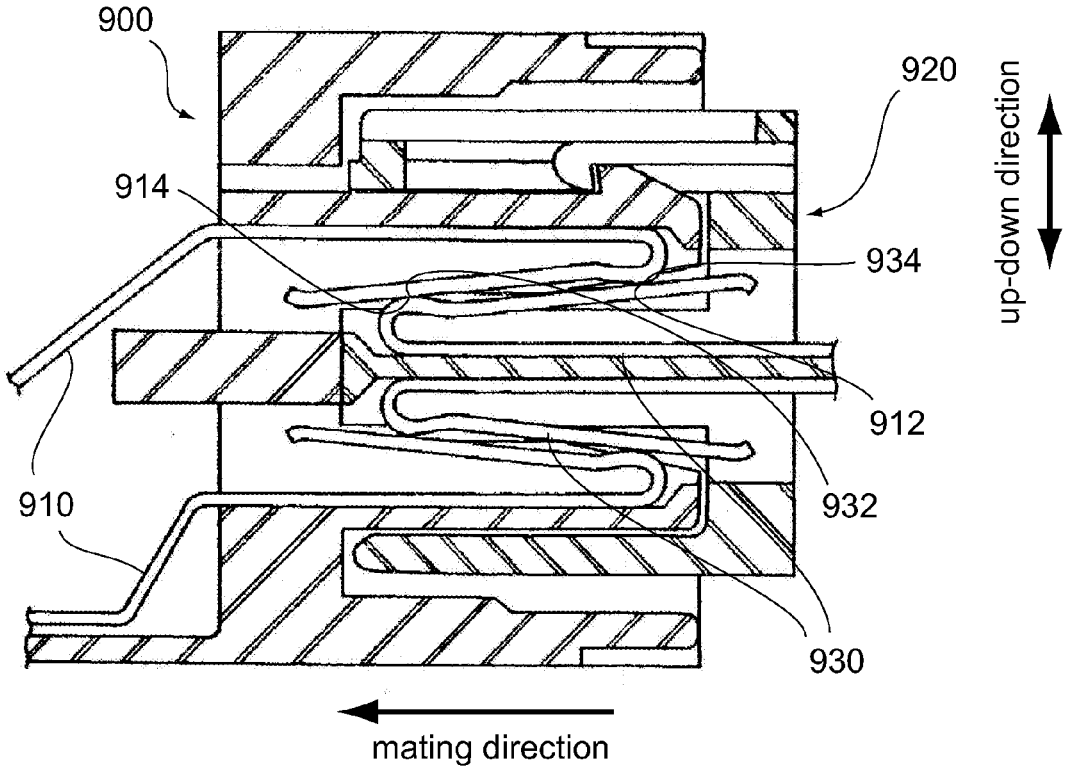
FIG. 24 PRIOR ART
FIG. 24 is a cross-sectional view showing a connector and a mating connector of Patent Document 1.
Figure 25:
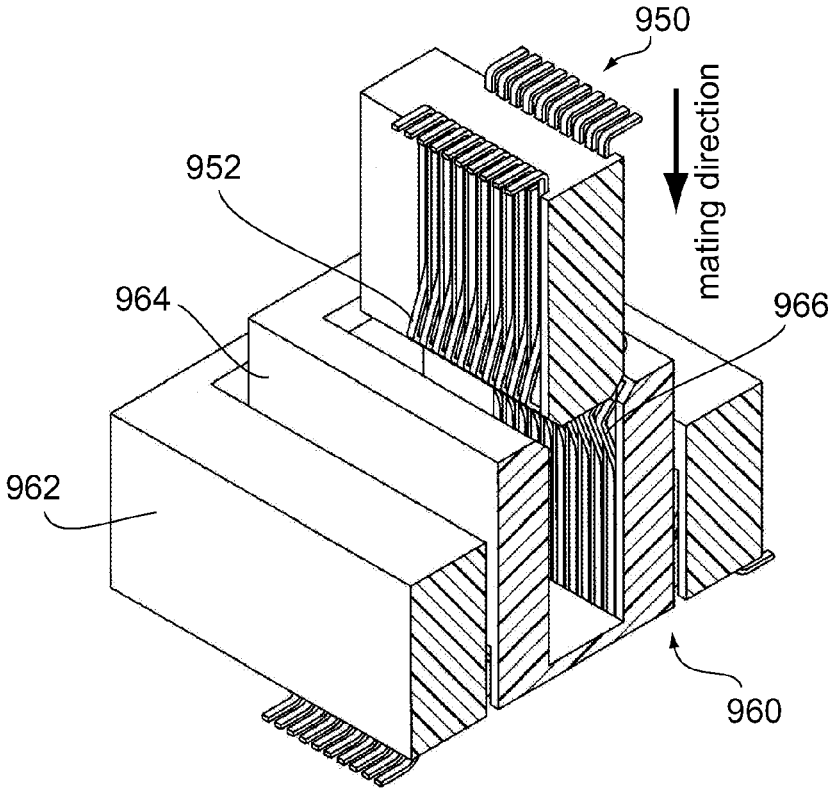
FIG. 25 PRIOR ART
FIG. 25 is a partially cut-away, perspective view showing a connector and a mating connector of Patent Document 2.

As can be seen from FIG. 23, when the connector 10A is transited from the mating start state to the mated state, the first contact portion 572A according to the present embodiment is moved in the negative Z-direction by the resilient deformation of the first spring portion 560A while being moved in the positive Z-direction by the resilient deformation of the second spring portion 580A.

In detail, the first contact portion 572A under the mating start state is located at an initial position (P0) in the Z-direction. Assuming that the first spring portion 560A keeps its shape under the mating start state when the connector 10A is transited from the mating start state to the mated state, the first contact portion 572A is moved from the initial position (P0) to a first position (P1) in the Z-direction only by the resilient deformation of the second spring portion 580A. However, in actual fact, because the first spring portion 560A is also resiliently deformed, the first contact portion 572A is moved to a second position (P2) in the Z-direction. As can be seen from the above explanation, the first contact portion 572A is moved by a first distance (D1), or a distance between the first position (P1) and the second position (P2) in the Z-direction, because of the resilient deformation of the first spring portion 560A. On the other hand, when the connector 10A is transited from the mating start state to the mated state, the second contact portion 586A according to the present embodiment is moved by a second distance (D2) in the Z-direction only because of the resilient deformation of the second spring portion 580A.

Although the first spring portion 560A shows a relatively small contact force under the mated state, the first spring portion 560A is largely deformed during the mating. In contrast, although the second spring portion 580A shows a relatively large contact force under the mated state, the second spring portion 580A is hardly deformed during the mating. Accordingly, the first distance (D1) is larger than the second distance (D2). Similar to the first embodiment, the first contact portion 572A is moved by the resilient deformations of two kinds of the springs. Accordingly, contact reliability between the first contact portion 572A and the second mating contact portion 856A can be improved.

As can be seen from FIGS. 21 and 22, while the connector 10A is transited from the mating start state to the mated state, a part of the slide portion 584A continuously receives a contact force from the first mating contact portion 846A. Under the mated state, the second contact portion 586A of the slide portion 584A receives a contact force (FE2) from the first mating contact portion 846A. The direction of the contact force (FE2) under the mated state is different from the direction of the contact force (FS2) under the mating start state. Under the mated state, the first contact portion 572A receives a contact force (FE1) from the second mating contact portion 856A.

According to the present embodiment, each of the direction of the contact force (FE1) and the direction of the second contact force (FE2) is perpendicular to the Z-direction. Accordingly, under the mated state, such a force that removes the mating connector 80A from the connector 10A is hardly generated. According to the present embodiment, similar to the first embodiment, the mated state can be relatively securely maintained. Moreover, the mating connector 80A can be easily removed from the connector 10A.

The mating contact 830A according to the present embodiment has a shape different from that of the contact 500A. However, similar to the first embodiment (see FIG. 17), a part of the mating contact 830A, which is brought into contact with the contact 500A, may have a shape and a size same as those of a part of the contact 500A, which is brought into contact with the mating contact 830A.

The present application is based on a Japanese patent application of JP2013-164975 filed before the Japan Patent Office on Aug. 8, 2013, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector mateable with a mating connector along a mating direction, wherein:

the mating connector comprises a mating contact;

the mating contact has a mating contact portion;

the connector comprises a contact;

the contact is brought into contact with the mating contact at two points under a mated state where the connector is mated with the mating connector;

the contact has a protruding portion, a first spring portion, a slide portion and a second spring portion;

the protruding portion protrudes from the first spring portion and has a first contact portion;

the first contact portion is movable by resilient deformation of the first spring portion to have a movement in a predetermined direction which is perpendicular to the mating direction;

the first contact portion is brought into contact with the mating contact under the mated state;

the slide portion extends flat and has a second contact portion;

the second contact portion is movable by resilient deformation of the second spring portion to have a movement in the predetermined direction;

the slide portion allows the mating contact portion to slide thereon to the second contact portion when the connector is transited from a mating start state to the mated state;

the mating start state is a state where the connector starts to be mated with the mating connector;

the second contact portion is brought into contact with the mating contact portion under the mated state; and one of the first contact portion and the second contact portion is moved in the predetermined direction because of both the resilient deformation of the first spring portion and the resilient deformation of the second spring portion when the connector is transited from the mating start state to the mated state.

2. The connector as recited in claim 1, wherein:

the connector comprises a housing; and the housing holds the contact.

3. The connector as recited in claim 1, wherein:

when the connector is transited from the mating start state to the mated state, the first contact portion is moved by a first distance in the predetermined direction because of the resilient deformation of the first spring portion while the second contact portion is moved by a second distance in the predetermined direction because of the resilient deformation of the second spring portion; and the second distance is larger than the first distance.

4. The connector as recited in claim 1, wherein:

when the connector is transited from the mating start state to the mated state, the first contact portion is moved by a first distance in the predetermined direction because of the resilient deformation of the first spring portion while the second contact portion is moved by a second distance in the predetermined direction because of the resilient deformation of the second spring portion; and the first distance is larger than the second distance.

5. The connector as recited in claim 1, wherein:

the first contact portion is located at a position different from that of the second contact portion in the predetermined direction; and when the connector is seen along the mating direction, the first contact portion and the second contact portion are visible.

6. The connector as recited in claim 1, wherein:

while the connector is transited from the mating start state to the mated state, a part of the slide portion continuously receives a contact force from the mating contact portion;

under the mated state, the second contact portion of the slide portion receives the contact force; and a direction of the contact force under the mated state is different from another direction of the contact force under the mating start state.

7. The connector as recited in claim 6, wherein the direction of the contact force under the mated state is perpendicular to the mating direction.

8. The connector as recited in claim 1, wherein:

under the mated state, the first contact portion receives a first contact force from the mating contact while the second contact portion receives a second contact force from the mating contact; and each of a direction of the first contact force and a direction of the second contact force is perpendicular to the mating direction.

9. The connector as recited in claim 1, wherein the contact is formed by punching out a single metal plate.

10. A connector mateable with a mating connector along a mating direction, wherein:

the mating connector comprises a mating contact;

the connector comprises a contact;

the contact is brought into contact with the mating contact at two points under a mated state where the connector is mated with the mating connector;

the contact has a first spring portion and a second spring portion;

the second spring portion has a first bent portion, a slide portion and a second bent portion;

the slide portion extends flat;

the first bent portion extends from one of opposite ends of the slide portion to intersect with the slide portion;

the first bent portion has a first contact portion;

the second bent portion extends from a remaining one of the opposite ends of the slide portion to intersect with the slide portion;

the second bent portion has a second contact portion;

the first contact portion is movable by resilient deformation of the first spring portion to have a movement in a predetermined direction which is perpendicular to the mating direction;

the first contact portion is brought into contact with the mating contact to receive a first contact force from the mating contact under the mated state;

the first contact force functions to maintain the mated state;

the second contact portion is movable by resilient deformation of the second spring portion to have a movement in the predetermined direction;

the second contact portion is brought into contact with the mating contact to receive a second contact force from the mating contact under the mated state;

the second contact force functions to maintain the mated state;

the second contact portion is moved in the predetermined direction because of both the resilient deformation of the first spring portion and the resilient deformation of the second spring portion when the connector is transited from the mating start state to the mated state; and the mating start state is a state where the connector starts to be mated with the mating connector.

* * * * *